United States Patent [19]

Krantz

[11] Patent Number: 4,880,226

[45] Date of Patent: Nov. 14, 1989

[54] SKIING SIMULATOR

[76] Inventor: Peter Krantz, 217 Demers, Montreal, Quebec, Canada, H2T lK6

[21] Appl. No.: 312,192

[22] Filed: Feb. 21, 1989

[51] Int. Cl.[4] ..... A63B 5/00; A63B 69/18

[52] U.S. Cl. ..... 272/97; 272/65; 272/135; 434/253

[58] Field of Search ..... 272/97, 65, 66, 93, 272/109, 144, 146, 145, 46–48, 94, 96, 69, DIG. 9, 134, 135, 136, 137, 142; 434/253; 128/25 R, 25 B

[56] References Cited

U.S. PATENT DOCUMENTS

| | | | |
|---|---|---|---|
| 3,659,844 | 5/1972 | Cummings | 272/146 |
| 3,831,935 | 8/1974 | Hofle | 272/97 |
| 4,429,869 | 2/1984 | Eckstein | 272/97 |
| 4,509,743 | 4/1985 | Lie | 272/97 |
| 4,730,826 | 3/1988 | Sudmeier | 272/97 |

*Primary Examiner*—S. R. Crow

*Attorney, Agent, or Firm*—Samuel Meerkreebs

[57] ABSTRACT

A skiing simulator which includes a platform formed by an annular peripheral frame defining an opening in which there is suspended a disc. The disc is suspended by tension springs extending between the edge of the disc and the peripheral frame. A pair of openings having parallel longitudinal axes are defined in the disc, and sole plates are adapted to rotate about the longitudinal axes in respective openings. A parallelogram linkage extends between the sole plates to control the parallel rotational movement therof, and a damper is connected between the disc and the linkage in order to provide resistance to the rotational movement of the sole plates. Ski boot bindings are fixed to each of the sole plates for receiving ski boots. A skier utilizing the skiing simulator can simulate forward and rearward tilting as well as translational lateral body movements of skiing.

7 Claims, 4 Drawing Sheets

40
16
42
43
10
18
24
28
22
28
20
26
30
14
30
12
32
32

SKIING SIMULATOR

BACKGROUND OF THE INVENTION

1. Field of the Invention

The present invention relates to an exercise device, and more particularly, to a skiing simulator.

2. Description of the Prior Art

Skiing simulators are known for Nordic or cross-country skiing. In fact, many such simulators are utilized by non-skiers as an excellent form of exercise. There are known alpine or downhill simulators, such as described in U.S. Pat. Nos. 4,429,869, Eckstein, issued Feb. 7, 1984; 4,509,743, Lie, issued Apr. 9, 1985; 4,629,181, Krive, issued Dec. 16, 1986; and 4,708,339, Perrine, issued Nov. 24, 1987. However, none of these devices allow for a more complex vertical translation movement which more closely simulates the movements to which the body is actually subjected when skiing.

Serious alpine skiers could utilize such an improved simulator all year round in order to maintain proper muscle tone, while novice skiers could learn and practice the required body movements on such a simulator.

SUMMARY OF THE INVENTION

It is an aim of the present invention to provide an alpine ski simulator which would meet the above requirements.

It is a further aim of the present invention to provide a simulator which could be easily installed and disassembled.

A construction in accordance with the present invention includes a simulator comprising a platform. The platform includes a peripheral frame defining an opening. A sub-platform is provided within the opening, and suspension means mount the sub-platform to the peripheral frame for relative vertical movement therewith. The suspension means includes tension means extending between the peripheral frame and the sub-platform for normally maintaining the sub-platform in the plane of the platform. The sub-platform defines a pair of openings having parallel longitudinal axes and a pair of boot receiving harnesses, one in each opening. Means are provided for mounting each boot in alignment with the longitudinal axis of the respective opening and rotatably about the respective longitudinal axis such that a person standing on the platform with a foot in each respective boot harness can simulate the body movement of downhill skiing.

In a more specific embodiment of the present invention, the boot receiving harnesses each include a sole plate for receiving a boot, and boot binding means are provided on the sole plate for detachably engaging and fixing a ski boot on the sole plate, and the sole is mounted on a shaft in the longitudnal axis journalled at each end to bearing means on the sub-platform.

In a more specific embodiment of the present invention, the sub-platform is a circular disc mounted within the opening of the platform, and tension coil springs extend from the peripheral frame to the edge of the disc to suspend the disc to allow for vertical movement.

In a still more specific embodiment of the present invention, there is provided a parallelogram linkage between the sole plates of the respective boot harnesses, and damping means provide resistance to the rotational movement of the respective sole plates.

Such an improved skiing simulator could also be used in ski stores to allow the proper fitting, by pre-testing, of ski boots.

Furthermore, this device could be a useful physiotherapy tool.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
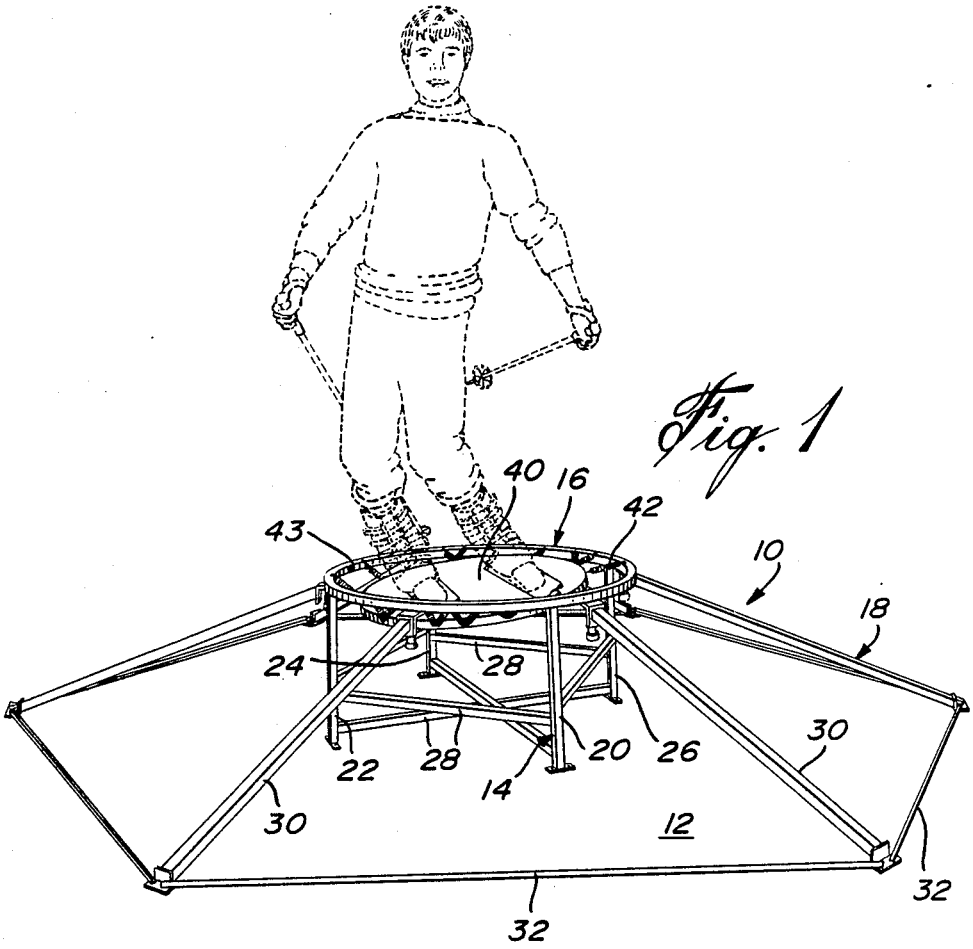
FIG. 1 is a perspective view of the present invention, showing a skier in dotted lines.
Figure 2:
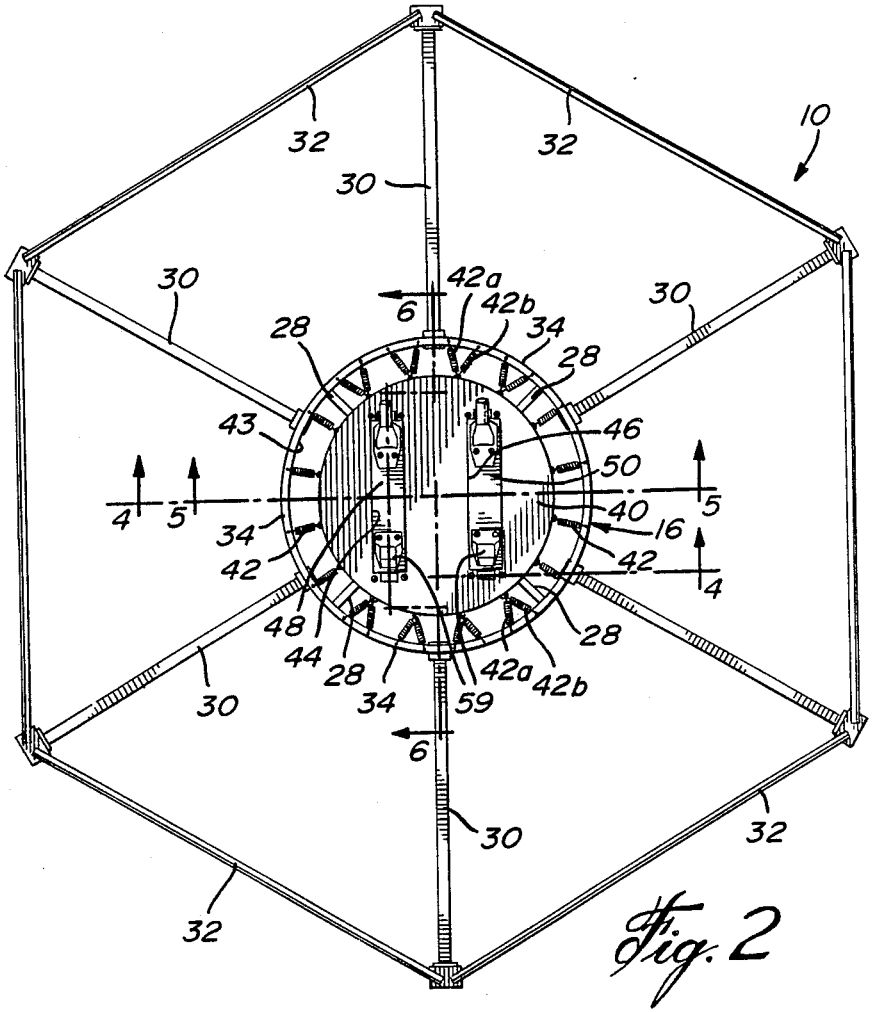
FIG. 2 is a top plan view thereof.
Figure 3:
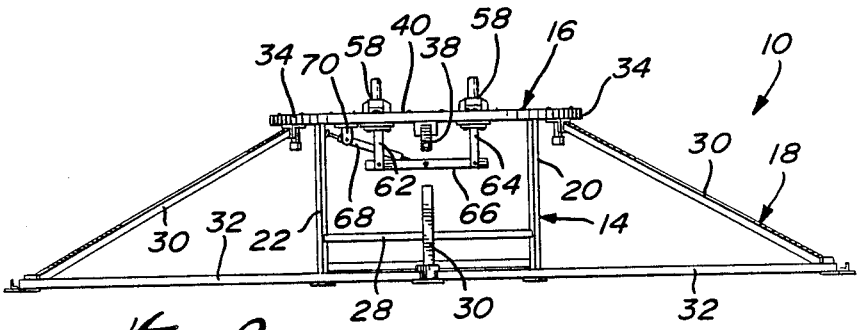
FIG. 3 is a front elevation thereof.

Reference is now made to the drawings, and in particular, FIGS. 1 to 3 which show a skiing simulator 10 which includes a support base 14 mounting a platform 16 spaced above a supporting surface 12. In the present embodiment, an outrigger support 18 is provided to stabilize the platform 16 on the base 14.

The base 14 includes vertical legs 20, 22, 24, and 26 stabilized by lateral braces 28. The outrigger support 18 includes outrigger struts 30 extending from a peripheral annular frame 34.

The platform 16 includes an annular peripheral frame 34. The outrigger struts 30 are connected to the annular frame 34 by means of connecting brackets 36 welded to the inner ends of struts 30 and nuts 38. Thus, the outrigger struts 30 can be easily dismantled or connected to the annular frame 34 by hand engagement of the nuts 38 which could be wing nuts.

The outer peripheral frame 34 defines an opening 43 in which is suspended a sub-platform or disc 40. The disc 40 is suspended by means of tension springs 42. The disc 40 is thus suspended in the opening 43 by way of the tension springs 42. Other forms of supporting the disc 40 may be provided to compensate the different weights which might be supported on the disc 40. For instance, it is contemplated to provide, in addition to the tension springs 42, a central post underneath the disc 40 which would extend between the disc 40 and the supporting surface 12. Such a supporting central post would allow the disc to pivot in various vertical directions. The disc could be further modified to allow rotation thereof. For instance, the disc could have an outer annular ring to which the tension springs are attached and a central plate rotatably mounted within the outer ring. The plate would be limited to 30° angular rotation, and could be urged back to an initial position by springs.

The disc 40 may have different constructions. In the embodiment shown in the present application, it is made from a single board, and anchors are provided peripherally of the disc 40 to anchor ends of the springs 42. In an embodiment not shown, an elastomeric sheet was sandwiched between two discs with the elastomeric sheet extending beyond the periphery of the disc 40 and anchors provided in the edges of the elastomeric sheet for engaging the springs 42. The tension springs 42 may be doubled as at 42*a* and 42*b* at oppositely located segments of the disc representing the front and rear of the skier.

Figure 4:
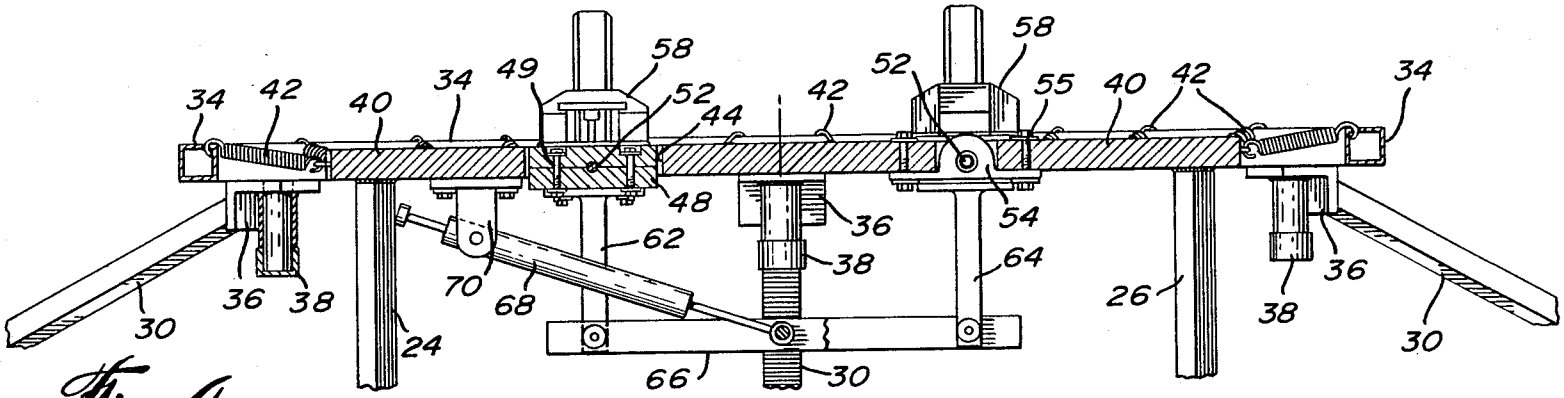
FIG. 4 is a vertical cross-section taken along line 4—4 in FIG. 2.
Figure 5:
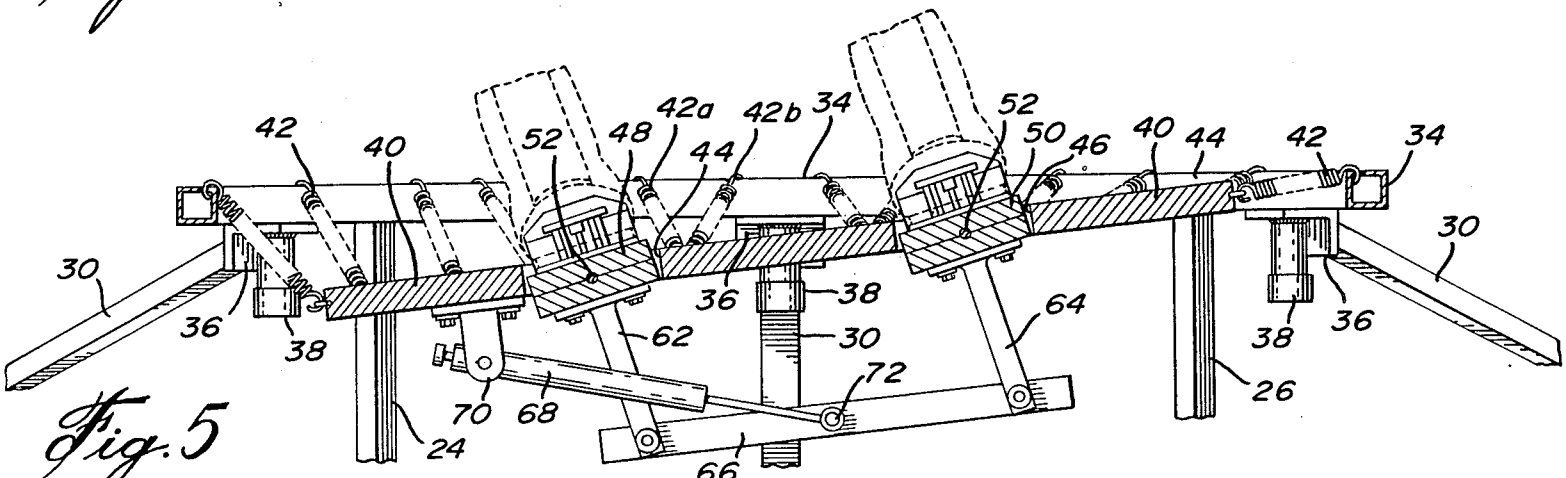
FIG. 5 is a vertical cross-section taken along line 5—5 in FIG. 2.

A pair of openings 44 and 46 are cut-out of the disc 40 and have longitudinal axes which are parallel and spaced apart. These longitudinal axes, as will be seen, are the longitudinal axes of the ski boots to be received thereon. Sole plates 48 and 50 are respectively mounted in each opening 44 and 46. A shaft 52 extends longitudinally through each sole plate 48 and 50 and is mounted at the front and rear of the openings in bearings 54 and 56 respectively. In one embodiment, as shown in FIGS. 4 and 5, the shaft 52 is sandwiched between a pair of plate members forming the respective sole plates 48 and 50. Nuts and bolts 49 may be provided to fasten the so-formed sandwich together.

The bearings 54 and 56, which are mounted at each end of the opening, are mounted to the disc 40. The bearings may be mounted to the disc 40 by means of nut and bolt arrangements 55.

On each sole plate 48 and 50, there is provided a ski binding 58 which includes a toe binding 59 and a heel binding 60. These bindings 58 may be conventional ski boot bindings for receiving ski boots. The heel binding 60 may be adjustable for different size boots by mounting the heel binding on parallel longitudinal track elements on the sole plate, for instance. Lateral adjustment of the sole plates is also contemplated by movement of the bearings on tracks. This would allow proper adjustment for different hip widths.

Figure 6:
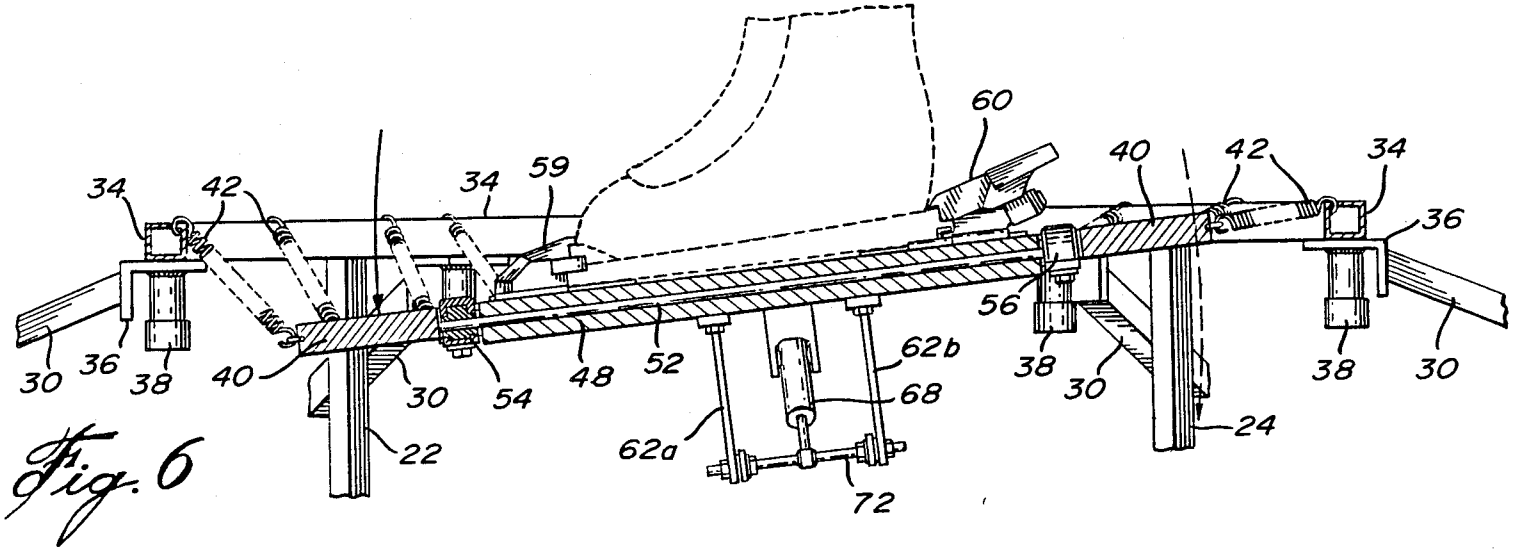
FIG. 6 is a vertical cross-section taken along line 6—6 in FIG. 2.

Because each sole plate 48 and 50 is mounted on a respective shaft 52, which rotates in bearings 54 and 56, each sole plate can rotate around a longitudinal axis defined by the shafts 52 in each opening 44 and 46. In order to control this rotational movement so that it simulates parallel ski movements, a parallelogram linkage formed by extension levers 62 and 64 connected by connecting bars 66 is provided. As shown in FIG. 6, the levers 62 and 64 may be double as represented by the levers 62*a* and 62*b*. A connecting rod 72 may extend between connecting bars 66 and is itself connected to a damping cylinder 68 which is mounted to a bracket 70 on the disc 40. The damping cylinder 68, which can be adjusted to different resistance settings, will provide resistance to the parallel rotation of the sole plates 48 and 50 in order to simulate the actual resistance to the edging movement of the skis on a hill.

In operation, a skier will don ski boots and then climb onto the disc 40 and have the ski boots engaged in the ski bindings 58 on respective sole plates 48 and 50. The skier will then practice various skiing movements, such as leaning forward, and thus against the tension springs 42*a* and *b*. A translatory movement is also possible in the lateral direction given the elasticity of the torsional springs 42 and the rotational movement of the sole plates 48 and 50 about shafts 52.

The device is also considered quite effective in practicing edging. For instance as the skier applies pressure on the sole plate which he selects as the outer ski, the pressure will cause the ski to dip in the direction of the pressure whereby the angle of the disk will resemble the angle of the slope and the skier can simulate edging because of the possibility of rotating the sole plates.

The outrigger struts 30 can, of course, be replaced by other devices for stabilizing the platform 16. In fact, the platform 16, including the annular frame 34, may be permanently mounted on a support structure which does not include the base 14 or the outrigger support 18.

I claim:

1. A skiing simulator comprising a platform, the platform including a peripheral frame and defining an opening, a sub-platform provided within the opening and suspension means mounting the sub-platform to the peripheral frame for relative universal directional tilting movement therewith, the suspension means including tension means extending between the peripheral frame and the sub-platform and normally maintaining the sub-platform in the plane of the platform, the simulator being characterized in that the sub-platform defines a pair of openings having parallel longitudinal axes and a pair of boot receiving harnesses, one in each opening, means for mounting a ski boot in alignment with the longitudinal axis of each respective opening and rotatably about the respective longitudinal axis, such that a person standing on the subplatform with a foot in each respective boot harness can simulate the body movement of a skier during downhill skiing.

2. A skiing simulator as defined in claim 1, wherein the boot receiving harnesses each include a sole plate, and the sole plate is mounted in its respective opening in the sub-frame for rotational movement about a longitudinal axis.

3. A skiing simulator as defined in claim 2, wherein each sole plate is mounted on a shaft which in turn extends in the longitudinal axis of the opening and is journalled at each end in bearing means mounted on the sub-platform.

4. A skiing simulator as defined in claim 2, wherein ski boot bindings are provided on each sole plate for engaging said ski boots.

5. A skiing simulator as defined in claim 1, wherein the sub-platform is in the form of a circular disc mounted within the opening defined by the frame, and tension coil springs extend from the peripheral frame to the edge of the disc to suspend the disc.

6. A skiing simulator as defined in claim 2, wherein a parallelogram linkage is provided between the sole plates, and damping means are provided between the sub-platform and the parallelogram linkage in order to provide resistance to the rotational movements of the respective sole plates.

7. A skiing simulator as defined in claim 1, wherein the platform is mounted to a portable base, including a plurality of legs connected to the peripheral frame, and detachable outrigger struts extend from the peripheral frame outwardly and downwardly therefrom to support, with the base, the platform in a position spaced above a support surface.

* * * * *